US005540194A

United States Patent [19]

Adams

[11] Patent Number: 5,540,194

[45] Date of Patent: Jul. 30, 1996

[54] RECIPROCATING SYSTEM

[76] Inventor: Joseph S. Adams, 340 Lepage Road, Ganges, British Columbia, Canada, V0S 1E0

[21] Appl. No.: 282,078

[22] Filed: Jul. 28, 1994

[51] Int. Cl.[6] ..... F02B 71/00

[52] U.S. Cl. ..... 123/46 R

[58] Field of Search ..... 123/46 R, 46 SC; 417/364, 380, 11, 342

[56] References Cited

U.S. PATENT DOCUMENTS

| | | | |
|---|---|---|---|
| 3,455,501 | 7/1969 | Urben | 123/46 R |
| 3,563,223 | 2/1971 | Ishida | 123/53 |
| 3,610,217 | 10/1971 | Braun | 123/321 |
| 3,751,905 | 8/1973 | McKinley et al. | 123/46 R |
| 3,859,966 | 1/1975 | Braun | 123/192.2 |
| 4,308,720 | 1/1982 | Brandstadter | 123/46 R |
| 4,381,043 | 4/1983 | Fukushima | 123/192.1 |
| 4,470,387 | 1/9984 | Gonska | 123/192.1 |
| 4,543,916 | 10/1985 | Giorno | 123/192.1 |
| 4,569,316 | 2/1986 | Suzuki | 123/192.1 |
| 4,683,849 | 8/1987 | Brown | 74/603 |
| 4,794,887 | 1/1989 | Valentine | 123/192.2 |
| 4,876,991 | 10/1989 | Galitello | 123/46 E |
| 5,202,200 | 4/1993 | Wright | 92/62 |
| 5,271,314 | 12/1993 | Derrien | 92/8 |
| 5,305,683 | 4/1994 | Gosdowski et al. | 92/13.5 |

FOREIGN PATENT DOCUMENTS 59-158331 9/1984 Japan .

*Primary Examiner*—David A. Okonsky
*Attorney, Agent, or Firm*—Eugene Stevens & Associates

[57] ABSTRACT

Three elements are hydraulically coupled by a hydraulic fluid contained within one of the elements serving as a housing so that reciprocally driven motion of one of the elements is transmitted to move another element responsively in a reciprocal motion. The movements can be counter-reciprocal or co-reciprocal, and the housing can be an unmoved element or can be one of the reciprocally moving elements. The stroke lengths and velocities of the reciprocal movements can vary, and the effect can involve dynamic balance, power transformation, vibrational dampening, and many variations of these possibilities.

45 Claims, 6 Drawing Sheets

RECIPROCATING SYSTEM

FIELD OF THE INVENTION

This invention involves reciprocating elements, at least one of which receives a power input.

BACKGROUND

This invention arose from a need to improve the dynamic balance of a reciprocating system. In meeting this need, I have intercoupled reciprocating elements in a new way that leads to several advantages. My coupling of reciprocating elements is not only fast, efficient, and reliable, but is easily varied to produce different effects, such as dynamic balance, shock absorption, and power input and output functions. These advantages allow my reciprocating system to outperform previous arrangements.

SUMMARY OF THE INVENTION

My system for coupling reciprocating elements uses hydraulic fluid communicating with a pair of reciprocating elements so that movement forced upon one of the reciprocating elements is transferred hydraulically to move the other element in the same or an opposite direction. The resulting reciprocating movements can be parallel or co-axial, and can involve sliding contact or separated paths. The hydraulic fluid coupling can be applied to one or both end regions of the reciprocating movements, and elements hydraulically coupled for counter- or co-reciprocating movement can be applied to an infinite variety of functions in engines and machines. Power can be input to either reciprocating element, making hydraulically transmitted movement of the other reciprocating element responsive; and the responsive element can be involved in power output. A housing holding the hydraulic coupling can be one of the reciprocating elements while containing another of the reciprocating elements. The stroke lengths, velocities, and masses of the reciprocating elements can be varied to transfer momentum from one to the other in different regions of the respective movement strokes, for tuning the relationship between the moving elements.

DRAWINGS

DETAILED DESCRIPTION

Figure 1:
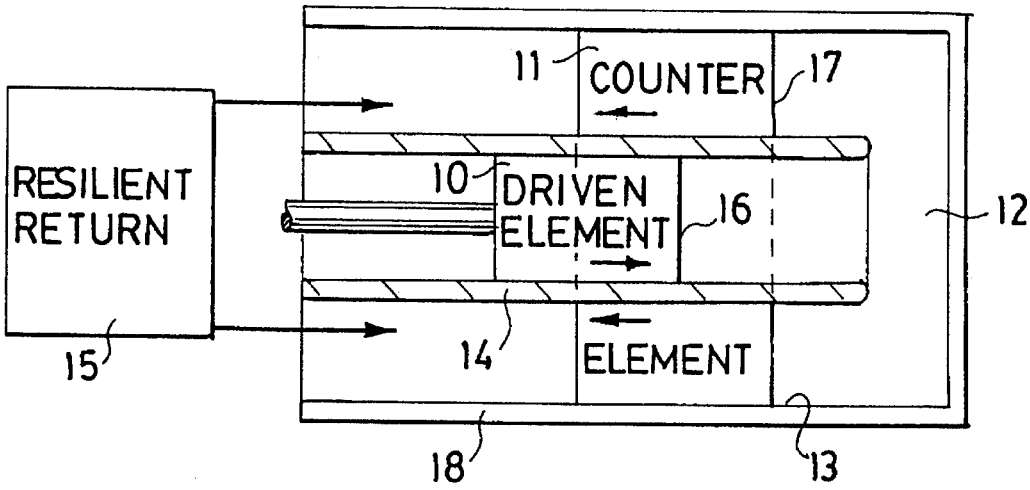
FIG. 1 is a schematic view of a simple form of my reciprocating system using a resilient return.

My system involves three interconnected elements at least two of which are movable reciprocally. A driven one of these receives the power input, and a responsive one can be involved in dynamic balance, power output, or other purposes. A hydraulic coupling involving hydraulic fluid communicates between the elements so that motion of the driven element is transmitted hydraulically to the responsive element. The hydraulic fluid is preferably contained within a housing that can constitute one of the elements. The housing can be moved or unmoved, as can the other two elements. The reciprocal motions can be counter-reciprocal or co-reciprocal, and the hydraulic coupling allows variation in stroke lengths and speeds of the movements. A few of the many applications of my invention are illustrated in the drawings.

A simple arrangement of a counter-reciprocating system is shown in FIG. 1 where motion of a driven element 10 is transmitted to a counter element 11 moving in an opposite direction. Both elements are arranged in communication with a hydraulic fluid 12 confined within a chamber 13 of an unmoved housing 18 so that movement of the driven element 10 to the right, as indicated by the arrow in FIG. 1, moves counter element 11 to the left, as indicated by the arrows in FIG. 1. Elements 10 and 11 are arranged to move co-axially of each other and can be separated by wall 14. The counter-reciprocating elements can also move in parallel with each other, preferably with one of the elements arranged to straddle the other. In the arrangement of FIG. 1, driven element 10 is a cylindrical piston moving reciprocally within wall 14, and counter element 11 is an annular element moving outside of wall 14 within chamber 13.

A resilient return 15 biases counter element 11 leftward against the direction of the arrows as shown in FIG. 1. This returns counter element 11 toward the right side of chamber 13 and moves driven element 10 leftward within wall 14. Resilient return 15 can be a spring or a volume of compressed air, acting against counter element 11 either directly or via a hydraulic system having an accumulator. A resilient return 15 can also be applied in an opposite direction to driven element 10.

Hydraulic fluid 12, which is confined in chamber 13, communicates with a working surface 16 of driven element 10 and with a working surface 17 of counter element 11. Working surfaces 16 and 17 can be varied in area, which changes the stroke length and velocity of counter element 11 relative to driven element 10. Any edges or corners of surfaces engaged by hydraulic fluid 12 are preferably rounded to minimize turbulence in hydraulic fluid 12, which changes shape as the counter-reciprocating strokes of elements 10 and 11 occur.

The counter-reciprocating elements 10 and 11 can have equal or unequal masses and still achieve the advantage of a counterbalancing effect. Making masses, stroke lengths, and velocities equal for elements 10 and 11 is one way of accomplishing this, but unequal masses can still have a counterbalancing effect if the stroke length and velocity of the smaller mass is made larger than the stroke length and velocity of the larger mass. The hydraulic intercoupling of elements 10 and 11 makes stroke length and velocity relationships easy to change by changing the size of the hydraulic working surfaces of the two elements.

Unequal masses can serve other purposes, though, since the division of momentum between the two elements and the transfer of momentum from one element to another at different periods of their reciprocating strokes can beneficially influence the way power is input or output. This can be useful in many applications, but one important application where it affords an advantage is in tuning the movement and timing of a two-stroke engine piston driving one of the reciprocating elements. Momentum can be transferred from the driven piston to the counter element during an early portion of the power stroke, when the piston is being accelerated by combustion forces. Then at the exhaust end of the piston travel, where it is desirable for the piston to dwell long enough to satisfy exhaust and intake requirements, the counter element can transfer momentum back to the piston.

Figure 2:
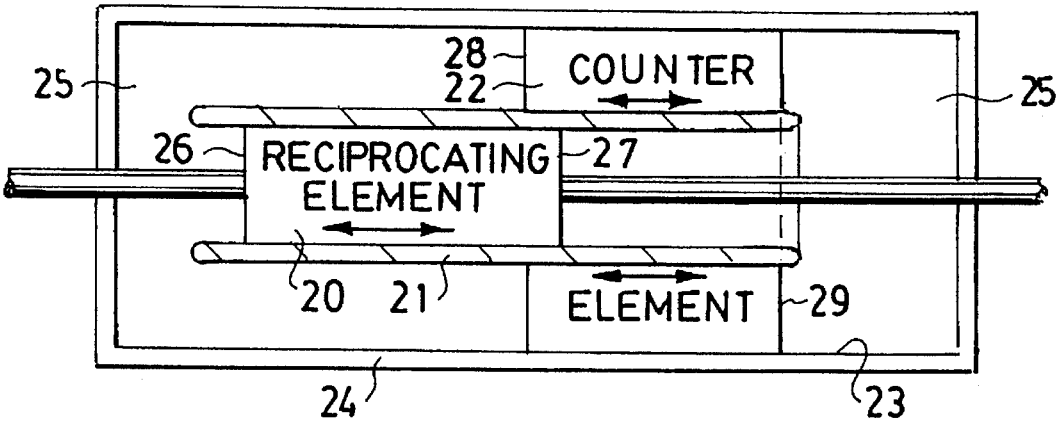
FIG. 2 is a schematic diagram of another embodiment of my reciprocating system applied to an element driven in opposite directions.

The counter-reciprocating System of FIG. 2 does not use any resilient return. It includes an element 20 that is reciprocally driven within a cylinder 21 and is countered by an element 22 moving outside of cylinder 21 and within chamber 23 of unmoved housing 24. The hydraulic coupling between elements 20 and 22 includes hydraulic fluid 25 that fills chamber 23 and engages working surfaces on both ends of each counter-reciprocating element. For driven element 20, these working surfaces are 26 and 27; and for responsive element 22, the working surfaces are 28 and 29. The reciprocal movement of element 20 can be provided by opposed pistons or other opposed drivers or can result from a drive motion in one direction and a resilient return motion in the opposite direction. Movement of element 20 in either direction causes counter movement of element 22 in an opposite direction because of the hydraulic interconnection via working surfaces 26–29.

Figure 3:
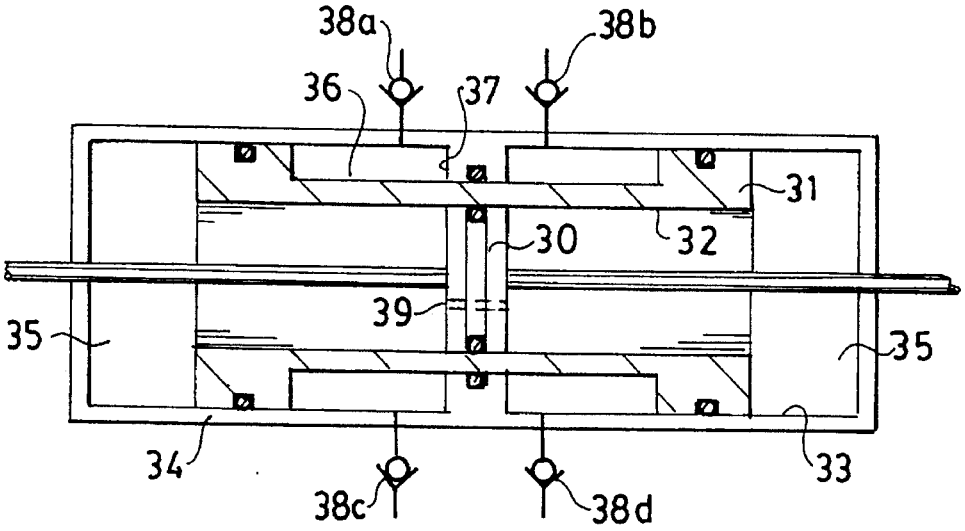
FIG. 3 is a schematic diagram of my reciprocating system producing a pumped output from a responsively-reciprocating element.

The counter-reciprocating system of FIG. 3 includes a reciprocating piston 30 and a Counter-reciprocating element 31 arranged to operate as a fluid pump. Driven piston 30 moves within a bore 32 of element 31, and both elements are arranged within a chamber 33 of a housing 34 where they are hydraulically coupled by a fluid 35. Movement of piston 30 in one direction hydraulically moves counter element 31 in an opposite direction, to achieve counter-reciprocating movements. Piston 30 can be driven back and forth in many ways, by many sources of power.

Hydraulic fluid 35 is divided into two volumes arranged on opposite sides of piston 30 and counter element 31. This disposes hydraulic fluid 35 at the end regions of the reciprocating strokes of each element. A bleed passageway 39 formed through piston 30 ensures that hydraulic pressures remain approximately equal at opposite ends of chamber 33, which automatically centers counter element 31 within chamber 33. Any eccentric positioning of counter element 31 and hydraulic fluid 35 would cause more pressure at one of the end regions of each of the counter-reciprocating strokes, and a hydraulic bleed passageway 39 prevents such a pressure build-up by equalizing the hydraulic end pressures, which in turn centers counter element 31 within chamber 33.

Counter element 31 has an annular cavity 36 that is divided into two parts by chamber wall 37. Each cavity part is connected to pumped fluid lines by check valves 38*a–d*. As counter element 31 moves back and forth in counter-reciprocal movement relative to piston 30, the divided portions of cavity 36 become larger and smaller, allowing element 31 to act as a pump in cooperation with check valves 38. As element 31 moves to the right, as shown in FIG. 3, a pumped outflow occurs through check valve 38*a* and an inflow occurs through check valve 38*d*. As element 31 moves leftward, as viewed in FIG. 3, a pumped outflow occurs through check valve 38*b*, and an inflow occurs through check valve 38*c*. These flows can be combined to form a pumped stream of fluid as element 31 reciprocates. Not only does element 31 have a counterbalancing effect relative to the mass that reciprocates with piston 30, but element 31 also outputs power in a different form than is input to piston 30.

Figure 4:
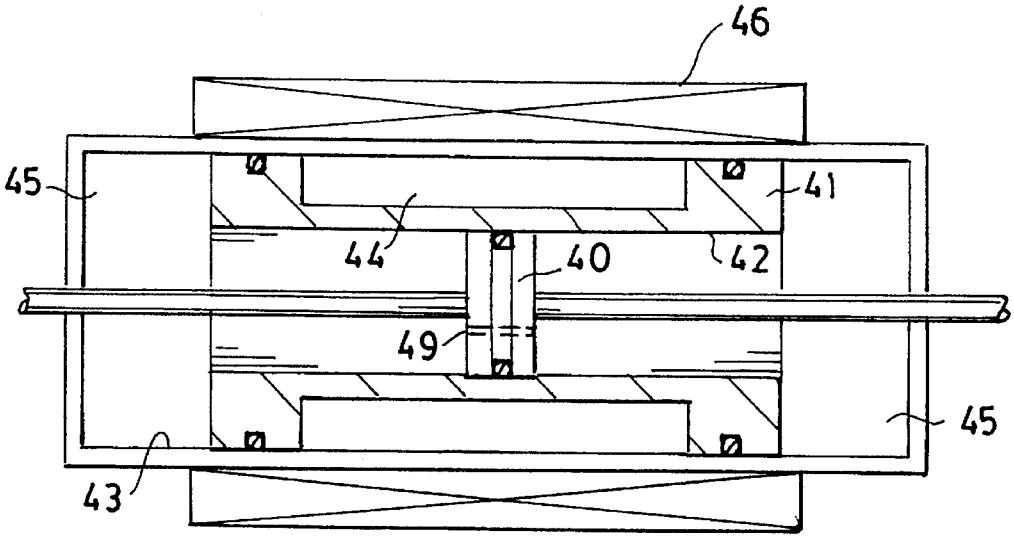
FIG. 4 is a schematic diagram of my counter-reciprocating system producing an electrical output from a counter-reciprocating element.

The counter-reciprocating system of FIG. 4 is similar to the arrangement of FIG. 3, in using a reciprocating piston 40 and a counter-reciprocating element 41, but differs in the way that element 41 is involved in a power output. Element 41 contains a magnet 44 that reciprocates within an electric coil 46 wound around chamber 43 to produce an electric power output. Magnet 44 can be divided into many magnets, and coil 46 is oriented so that reciprocal movement of element 41 produces an electrical output. Otherwise, piston 40 moves reciprocally within bore 42 of element 41, and the motion of piston 40 is hydraulically transmitted to element 41 by hydraulic fluid 45 so that elements 40 and 41 move counter-reciprocally.

In either of the embodiments of FIGS. 3 and 4, the power transfer produced by counter element 31 or 41 can be converted to a power input that moves element 31 or 41 reciprocally to cause a counter-reciprocal movement of piston 30 or 40. This can be used for many purposes, including starting an internal combustion engine having a combustion piston connected with piston 30 or 40. Generally, power input can be supplied to either of the counter-reciprocating elements, for hydraulically driving the other element counter-reciprocally in response.

Figure 5:
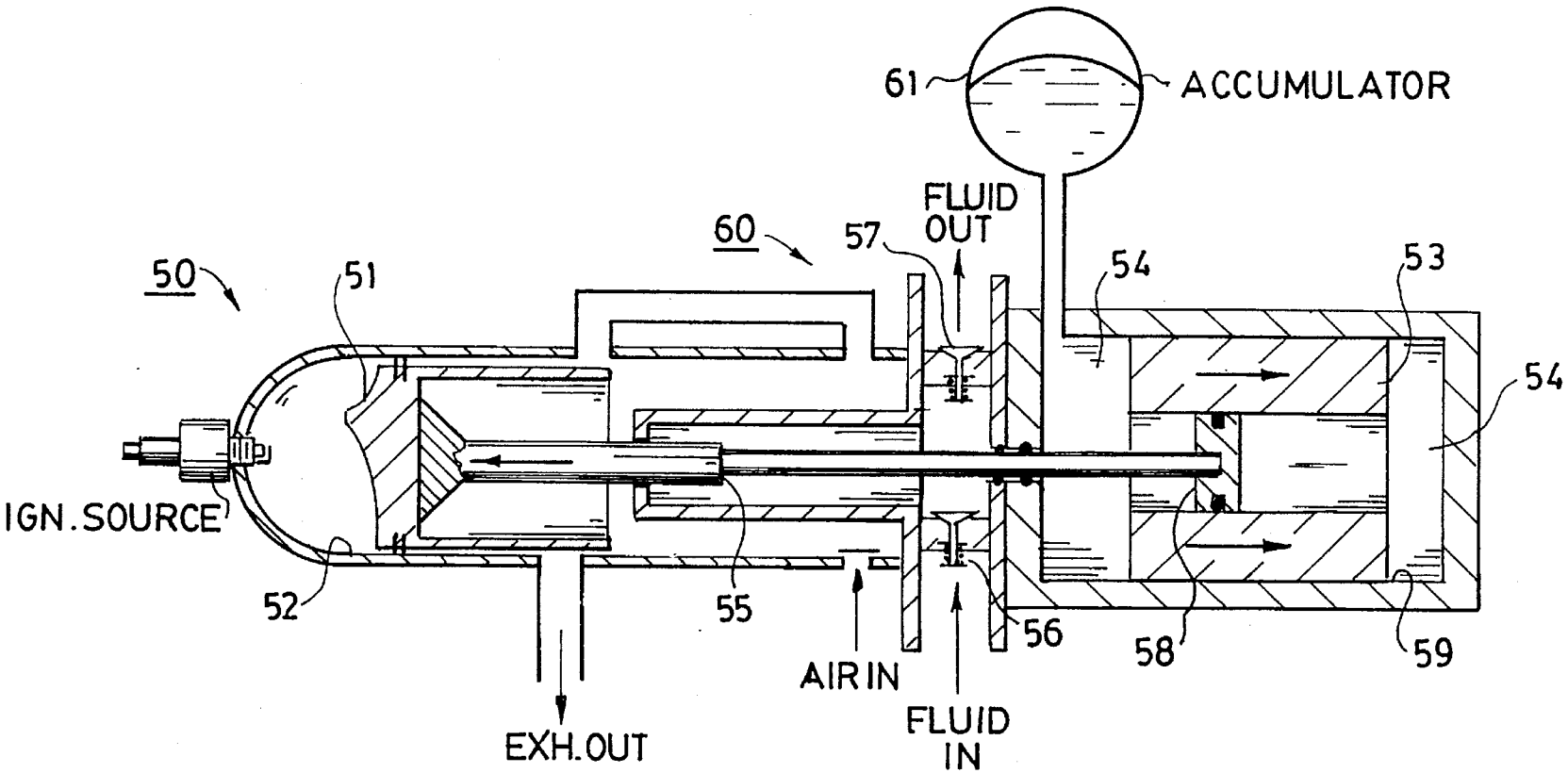
FIG. 5 is a partially schematic, cut-away view of a linear internal combustion engine operating a pump and provided with a counter-reciprocating element and return mechanism according to the invention.

The counter-reciprocating system of FIG. 5 is similar to the one shown in FIG. 1 and illustrates application of the system to a two-stroke linear engine 50 driving a pump 60. Combustion piston 51 moves reciprocally within cylinder 52 and drives a linearly reciprocal piston 55 of pump 60. Check valves 56 and 57 cause pumped fluid flow as piston 55 reciprocates. A counter element 53 is hydraulically coupled to reciprocally driven piston 58 by hydraulic fluid 54 so that counter element 53 moves counter-reciprocally to pistons 58, 55, and 51. The return stroke for all these pistons is provided by hydraulic accumulator 61 acting on hydraulic fluid 54 to drive element 53 in the direction of the arrows. This moves pistons 58, 55, and 51 leftward as indicated by the arrow in FIG. 5. The opposite reciprocal motions occur on a power stroke driving piston 51 toward the right as viewed in FIG. 5.

Figure 6:
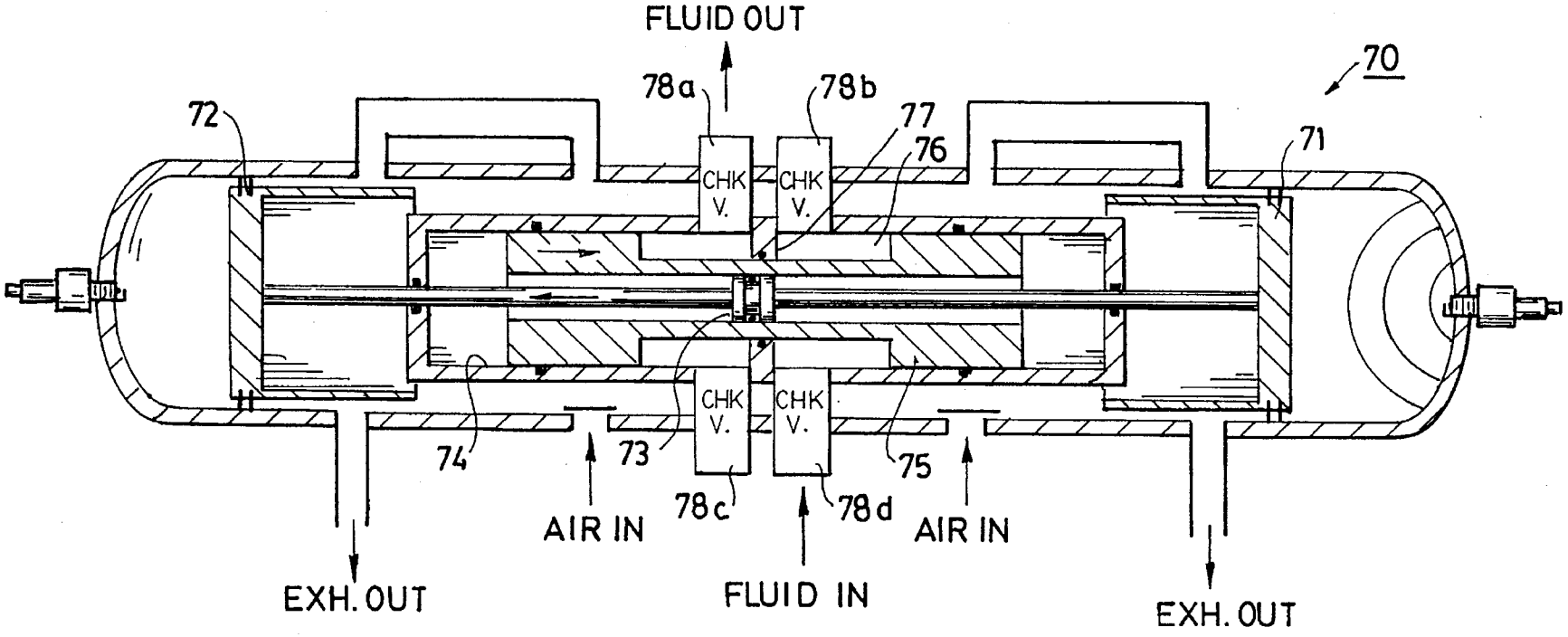
FIGS. 6 and 7 are partially schematic, cut-away views of an opposed piston linear engine with a counter-reciprocating element serving as a pump—a stroke in one direction being illustrated in FIG. 6, and a stroke in an opposite direction being illustrated in FIG. 7.
Figure 7:
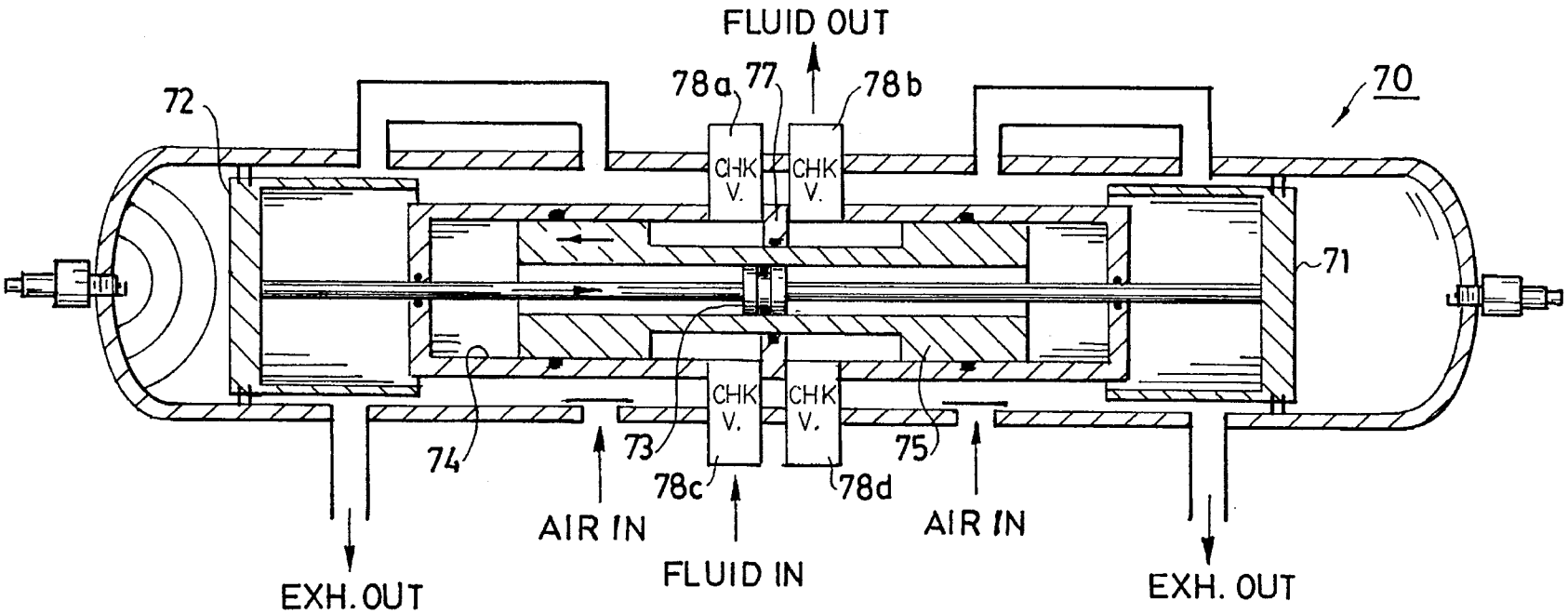

The counter-reciprocating system of FIGS. 6 and 7 provides a pumped output for an opposed twin cylinder, two-stroke engine 70. Combustion pistons 71 and 72 are driven reciprocally within engine 70, which reciprocates piston 73 within chamber 74 where counter element 75 moves counter-reciprocally. A cavity 76 in element 75 is divided by a wall 77, and check valves 78*a–d* are arranged so that changes in cavity sizes on opposite sides of wall 77 serve as a fluid pump. On a leftward stroke of combustion pistons 71 and 72, as illustrated in FIG. 6, pumped fluid is drawn in through check valve 78*d* and is pumped out through check valve 78*a*. On a rightward stroke, as illustrated in FIG. 7, pumped fluid is drawn in through check valve 78*c* and is pumped out through check valve 78*b*.

Co-reciprocal movement of elements is also possible, especially when a housing containing the hydraulic fluid coupling is one of the reciprocating elements. This is possible since any system according to my invention involves three elements, two of which reciprocate, and one of which is unmoved; and the housing containing the fluid coupling can function as either a moving or an unmoved element, depending on the goal that is sought. The unmoved element need not necessarily be fixed or held in an immovable position, but it need not participate in the reciprocal motions of either the driven or responsive elements.

Figure 8:
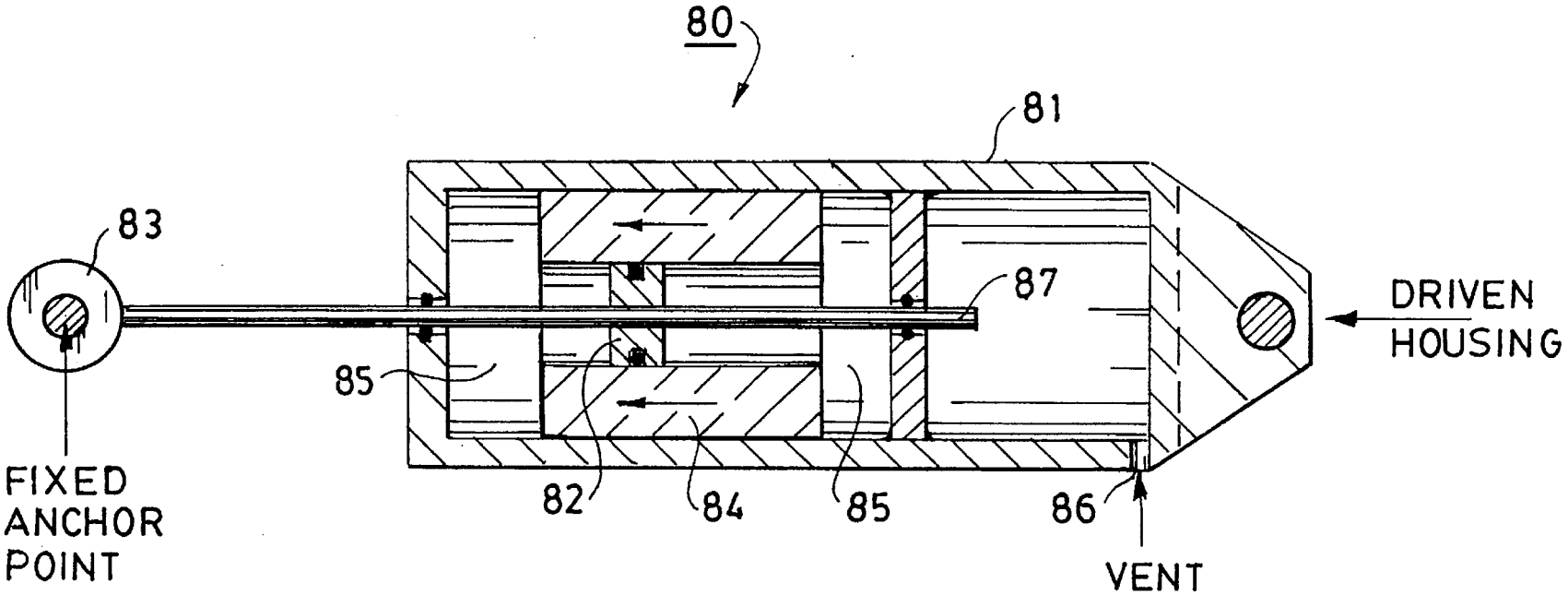
FIG. 8 is a partially schematic diagram of a reciprocating system involving reciprocal movement of a housing.

Device 80 of FIG. 8 represents a co-reciprocal motion involving a housing 81 that serves as the driven reciprocal element. The unmoved element is piston 82 that is anchored at a fixed point 83. The responsively reciprocating element 84 is hydraulically coupled to piston 82 by hydraulic fluid 85, which is also in communication with housing 81. As housing 81 is driven in a reciprocal motion, which could involve a vibration, for example, its movement is transmitted by hydraulic fluid 85 to move responsive element 84 co-reciprocally with housing 81. Vent 86 accommodates movement of housing 81 relative to rod 87 connected to piston 82 and anchor point 83. The speed and stroke length of movement of responsive element 84 can differ from the speed and stroke length of reciprocally driven housing 81 to achieve a variety of purposes such as power output, dynamic balance, shock absorption, or vibrational dampening. The movement imparted to responsive element 84 by movement of housing 81 can be coupled to other elements by mechanical, electrical, or hydraulic coupling systems such as described above for counter-reciprocating embodiments.

Many other variations on co-reciprocating systems are also possible. For example, power can be input to an element moveable within a housing, such as element 84 so that a housing, such as housing 81, moves responsively by a hydraulic coupling, such as coupling 85. An unmoved element, such as piston 82, can complete the hydraulic coupling between the reciprocating elements and can serve as a reference for the other movements. A vibration dampening system can use the vibration to be damped as a drive force reciprocating one element that is hydraulically coupled to another so that the vibrational motion is transmitted to a responsive mass moving reciprocally at a velocity and direction that dampens the original vibration relative to a fixed mount. Once the hydraulic coupling between unmoved, driven, and responsive elements is understood, a multitude of variations of such an arrangement become available to meet a corresponding multitude of needs for reciprocal movements.

I claim:

1. A reciprocating system comprising three elements interrelated so that:

a. one of the elements is a housing containing hydraulic fluid serving as a hydraulic coupling;

b. two of the elements are arranged within the housing in communication with the hydraulic coupling;

c. one of the elements is fixed and two of the elements are movable;

d. one of the movable elements is a driven element moved in a driven reciprocal motion;

e. another of the movable elements is a responsive element moved in a responsive reciprocal motion;

f. the hydraulic coupling transmits movement from the driven element to cause the responsive element to move in the responsive reciprocal motion; and g. the driven and responsive reciprocal motions are coaxial.

2. The system of claim 1 wherein the responsive reciprocal motion is counter to the driven reciprocal motion.

3. The system of claim 1 wherein the driven and responsive reciprocal motions differ in stroke and velocity.

4. The system of claim 1 wherein the responsive reciprocal motion has an unvarying phase relation to the driven reciprocal motion.

5. The system of claim 1 wherein energy stored in the responsive element is returned to the driven element during a predetermined portion of the driven reciprocal motion.

6. The system of claim 1 wherein the hydraulic coupling divides momentum between the driven and responsive elements.

7. The system of claim 1 wherein a resilient system biases movement of one of the reciprocating elements in one direction.

8. The system of claim 1 wherein power is output from the responsive element.

9. The system of claim 1 wherein a wall is arranged between an inner and an outer one of the moving elements.

10. The system of claim 1 wherein the driven element includes a piston of an internal combustion engine, and the responsive element receives a power input for moving the piston to start the engine.

11. The system of claim 1 wherein the driven and responsive reciprocal motions do not substantially move the center of gravity of the system.

12. The system of claim 1 wherein the hydraulic coupling transits both directions of driven reciprocal motion to the responsive element.

13. The system of claim 1 wherein the hydraulic fluid is divided into two volumes arranged at opposite end regions of reciprocating strokes of the reciprocating elements.

14. The system of claim 1 wherein power is output from the responsive element.

15. The system of claim 1 wherein the driven element is the housing.

16. The reciprocating system for a driven element moved in a driven reciprocating motion, the reciprocating system comprising:

a. hydraulic fluid arranged in communication with opposite end regions of the driven reciprocating element;

b. a responsive element having opposite end regions arranged in communication with the hydraulic fluid; and c. reciprocating motion of the driven element is transmitted via the hydraulic fluid to move the responsive element in a responsively reciprocating motion in an unvarying phase relation to the driven reciprocating motion.

17. The system of claim 16 wherein power output is derived form the responsive element.

18. The system of claim 16 wherein the driven element and the responsive element are arranged for moving coaxially.

19. The system of claim 16 wherein the driven element and the responsive element are arranged for moving coaxially within a housing containing the hydraulic fluid so that the driven and responsive reciprocal motions do not substantially move the center of gravity of the system.

20. The system of claim 16 wherein the hydraulic fluid changes shape during movement of the driven element and the responsive element.

21. The system of claim 16 wherein the hydraulic fluid transits both reciprocating strokes of the driven element to the responsive element, and power output is derived from the responsive element.

22. The system of claim 21 wherein momentum is divided between the driven element and the responsive element.

23. The system of claim 19 wherein the driven element and the responsive element are separated by a wall.

24. The system of claim 22 wherein energy stored in the responsive element is returned tot he driven element during a predetermined portion of the driven reciprocating motion.

25. The system of claim 16 wherein a resilient system biases one of the reciprocating elements in a predetermined direction.

26. The system of claim 16 wherein the driven element is formed as a housing contained the hydraulic fluid and the responsive element.

27. The system of claim 26 wherein the responsive element moves co-reciprocally with the housing.

28. The system of claim 16 wherein the responsive reciprocating motion is counter to the driven reciprocating motion.

29. The system of claim 16 wherein the driven and responsive reciprocating motions differ in velocity and stroke.

30. The system of claim 16 wherein the hydraulic fluid is contained one of the reciprocating elements.

31. The system of claim 16 wherein the driven and responsive reciprocal motions do not substantially move the center of gravity of the system.

32. A reciprocating system comprising:

a. three interrelated elements that include a driven element moved in a reciprocal motion, a responsive element moved in a responsive reciprocal motion, and an unmoved element;

b. a hydraulic coupling that transits motion of the driven element to the responsive element to cause the responsive element to move in the responsive reciprocal motion so that a portion of the energy delivered to the driven element is transferred to and temporarily stored in the responsive element;

c. the hydraulic coupling being confined within a housing that constitutes one of the elements; and d. the driven and responsive reciprocal motions are coaxial.

33. The system of claim 32 wherein the driven element is the housing, and the responsive element moves co-reciprocally with the housing.

34. The system of claim 33 wherein the hydraulic coupling gives the co-reciprocal motion of the responsive element a velocity and stroke different from the velocity and stroke of the housing motion.

35. The system of claim 32 wherein the responsive element and the driven element are arranged with in the housing and move counter-reciprocally relative to each other.

36. The system of claim 35 wherein the stroke lengths and velocities of the counter-reciprocating elements differ from each other.

37. The system of claim 32 wherein the energy temporarily stored in the responsive element is returned to the driven element during a predetermined portion of the driven reciprocal motion.

38. The system of claim 32 wherein the driven element and the unmoved element are arranged within the housing, and the housing moves co-reciprocally with the driven element.

39. The system of claim 38 wherein the hydraulic coupling gives the co-reciprocal motion of the housing a velocity and stroke different from the velocity and stroke of the driven element.

40. The system of claim 32 wherein the hydraulic coupling divides momentum between the driven and responsive element and transits both directions of the driven reciprocal motion to the responsive element.

41. The system of claim 32 wherein power is output from the responsive element.

42. The system of claim 32 wherein the driven and responsive reciprocal motions do not substantially move the center of gravity of the system.

43. The system of claim 32 wherein the hydraulic fluid is contained at each end region of the reciprocating strokes of the elements.

44. The system of claim 43 wherein the driven and responsive elements are separated by a wall and do not substantially move the center of gravity of the system.

45. The system of claim 32 wherein the responsive reciprocal motion has an unvarying phase relation to the driven reciprocal motion.

* * * * *